US008847997B2

(12) United States Patent
Seo et al.

(10) Patent No.: US 8,847,997 B2
(45) Date of Patent: Sep. 30, 2014

(54) ORGANIC LIGHT EMITTING DISPLAY, METHOD FOR DRIVING THE SAME, AND DRIVER THEREFOR

(75) Inventors: Hae-Kwan Seo, Suwon-si (KR); Ki-Nyeng Kang, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1099 days.

(21) Appl. No.: 12/379,859

(22) Filed: Mar. 3, 2009

(65) Prior Publication Data

US 2009/0231246 A1 Sep. 17, 2009

(30) Foreign Application Priority Data

Mar. 13, 2008 (KR) ..... 10-2008-0023179

(51) Int. Cl.
*G09G 5/10* (2006.01)
*G09G 3/30* (2006.01)
*G09G 3/32* (2006.01)

(52) U.S. Cl.
CPC ..... *G09G 3/3225* (2013.01); *G09G 2360/16* (2013.01)
USPC ..... 345/690; 345/76; 345/77

(58) Field of Classification Search
USPC ..... 345/76–84, 204–215, 690–699; 315/169.1–169.4
See application file for complete search history.

(56) References Cited

U.S. PATENT DOCUMENTS

| | | | | |
|---|---|---|---|---|
| 6,351,077 | B1 * | 2/2002 | Koyama | 315/169.3 |
| 6,970,149 | B2 | 11/2005 | Chung et al. | |
| 2005/0024339 | A1 | 2/2005 | Yamazaki et al. | |
| 2005/0253789 | A1 | 11/2005 | Ikeda | |
| 2006/0033445 | A1 * | 2/2006 | Kim et al. | 315/169.3 |
| 2006/0077491 | A1 * | 4/2006 | Morita | 358/519 |
| 2007/0069995 | A1 * | 3/2007 | Shin et al. | 345/76 |
| 2007/0242007 | A1 | 10/2007 | Lee et al. | |

FOREIGN PATENT DOCUMENTS

| | | | |
|---|---|---|---|
| GB | 2 337 354 | A | 11/1999 |
| JP | 2005-092041 | | 4/2005 |
| JP | 2005-092046 | | 4/2005 |
| JP | 2005-227688 | | 8/2005 |
| KR | 10-1999-0088200 | A | 12/1999 |
| KR | 10-2004-0024398 | A | 3/2004 |
| KR | 10-2005-0037126 | A | 4/2005 |
| KR | 10-2005-0107465 | A | 11/2005 |

* cited by examiner

*Primary Examiner* — Patrick F Marinelli
(74) *Attorney, Agent, or Firm* — Lee & Morse, P.C.

(57) ABSTRACT

An organic light emitting display includes pixels, each pixel having a transparent transistor, a timing controller to convert predetermined bits of an externally supplied first data into a certain value to generate a second data, and a data driver configured to receive the second data, to generate a data signal from the second data, and to supply the data signal to data lines coupled to the pixels.

6 Claims, 3 Drawing Sheets

ORGANIC LIGHT EMITTING DISPLAY, METHOD FOR DRIVING THE SAME, AND DRIVER THEREFOR

BACKGROUND OF THE INVENTION

1. Field of the Invention

Embodiments relate to an organic light emitting display, a method of driving the same, and a driver therefor. More particularly, embodiments relate to an organic light emitting display capable of improving image quality, a method of driving the same, and a driver therefor.

2. Description of the Related Art

In recent years, there have been many attempts to develop various flat panel displays that overcome disadvantages of cathode ray tubes, e.g., excessive weight and volume. Flat panel displays include a liquid crystal display (LCD), a field emission display (FED), a plasma display panel (PDP), an organic light emitting display, etc.

Organic light emitting displays display an image using an organic light emitting diode (OLED) generating light by recombining electrons and holes. Such an organic light emitting display has many advantages, including rapid response time and low power consumption.

Each pixel in the organic light emitting display includes at least one thin film transistor. In recent years, there has been an increasing attempt use transparent thin film transistors in the pixels. A transparent panel including transparent thin film transistors may be used in variety of applications.

However, such transparent panels may not be able to display a high-definition image. In particular, since background information from behind the display panel is transmitted through transparent panels in black regions, i.e., regions emitting no light, high-definition images cannot be displayed.

SUMMARY OF THE INVENTION

Embodiments are therefore directed to an organic light emitting display, a method of driving the same, and a driver therefor, which substantially overcome one or more of the disadvantages of the related art.

It is therefore a feature of an embodiment to provide an organic light emitting display having a transparent panel capable of displaying a high-definition image.

It is therefore another feature of an embodiment to provide a method for driving an organic light emitting display having a transparent panel capable of displaying a high-definition image.

It is therefore yet another feature of an embodiment to provide a driver for an organic light emitting display having a transparent panel capable of displaying a high-definition image.

At least one of the above and other features and advantages may be realized by providing an organic light emitting display, including pixels, each pixel including a transparent transistor, a timing controller configured to convert at least one predetermined bit of an externally supplied first data to a certain value to generate a second data, and a data driver configured to receive the second data, to generate a data signal from the second data, and to supply the data signal to data lines coupled to the pixels.

The certain value may be "1." The first data may have i (i is an integer) bits, and the second data may have j (j is an integer greater than or equal to i) bits. The at least one predetermined bit may be one or (j−i) predetermined bits.

The organic light emitting display may further include a frame memory configured to store one frame of the first data, and a grey level judging unit configured to supply a control signal to the timing controller corresponding to the grey level value of the first data stored in the frame memory. The grey level judging unit may be configured to generate a control signal to control the at least one predetermined bit to be an upper bit value when the first data stored in the frame memory have a high difference in grey levels and to control the at least one predetermined bit to be a lower bit value when the first data have a low difference in grey levels. The at least one predetermined bit may be a most significant bit or may be a least significant bit.

At least one of the above and other features and advantages may be realized by providing a method for driving an organic light emitting display having pixels, each pixel including a transparent transistor, the method including generating a second data by fixing predetermined bits of externally supplied first data to a certain value, generating a data signal using the second data, and displaying an image using the data signal.

The certain value may be "1." The first data may have i (i is an integer) bits, and the second data may have j (j is an integer that is greater than or equal to i) bits. The at least one predetermined bit may be one or (j−i) predetermined bits.

The method may further include storing one frame of the first data and determining a position of at least one predetermined bit to correspond to a difference in grey level values of the first data in the stored one frame. The position of the at least one predetermined bit may increase with an increasing difference in grey level values of the first data in the stored one frame.

At least one of the above and other features and advantages may be realized by providing a driver configured to drive an organic light emitting display, the driver including a timing controller configured to convert at least one predetermined bit of an externally supplied first data to a certain value to generate a second data, and a data driver configured to receive the second data, to generate a data signal from the second data, and to supply the data signal to data lines coupled to the organic light emitting display.

The certain value may be "1." The first data may have i (i is an integer) bits, and the second data may have j (j is an integer greater than or equal to i) bits. The at least one predetermined bit may be one or (j−i) predetermined bits.

The driver may further include a frame memory configured to store one frame of the first data, and a grey level judging unit configured to supply a control signal to the timing controller corresponding to the grey level value of the first data stored in the frame memory. The grey level judging unit may be configured to generate a control signal to control the at least one predetermined bit to be an upper bit value when the first data stored in the frame memory have a high difference in grey levels and to control the at least one predetermined bit to be a lower bit value when the first data have a low difference in grey levels.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION OF THE INVENTION

Figure 1:
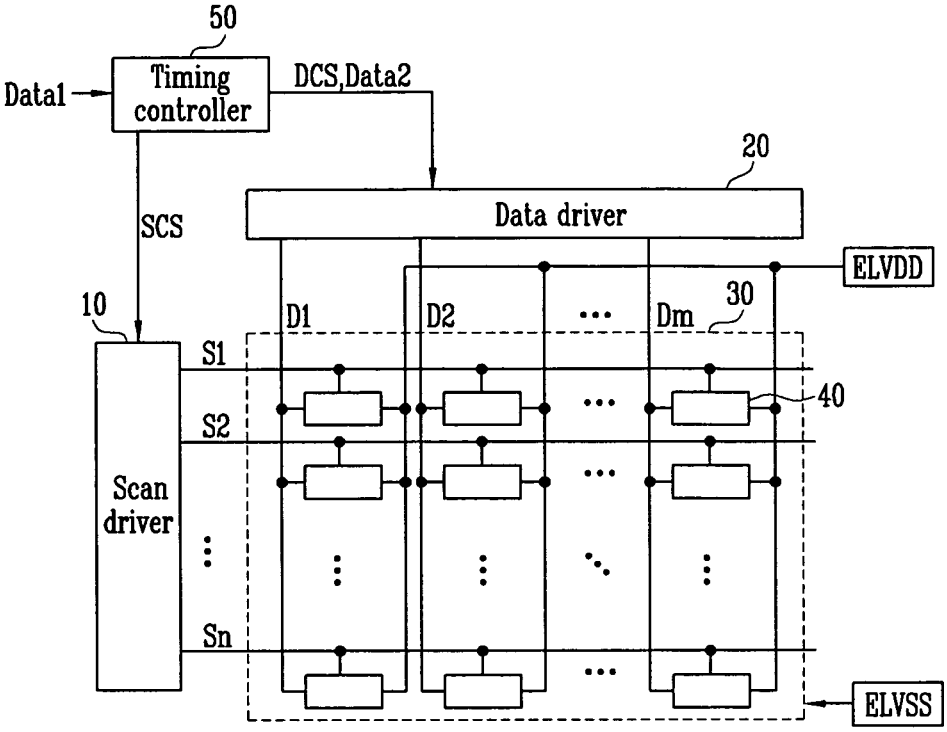
FIG. 1 illustrates a diagram of an organic light emitting display according to one exemplary embodiment of the present invention.

Korean Patent Application No. 10-2008-0023179, filed on Mar. 13, 2008, in the Korean Intellectual Property Office, and entitled: "Organic Light Emitting Display and Method for Driving the Same," is incorporated by reference herein in its entirety.

Hereinafter, certain exemplary embodiments according to the present invention will be described with reference to the accompanying drawings. Here, when a first element is described as being coupled to a second element, the first element may be not only directly coupled to the second element, but may also be indirectly coupled to the second element via a third element. Further, some of the elements that are not essential to the complete understanding of the invention may be omitted for clarity. Also, like reference numerals refer to like elements throughout.

FIG. 1 illustrates an organic light emitting display according to one exemplary embodiment of the present invention.

Referring to FIG. 1, the organic light emitting display according to one exemplary embodiment of the present invention may include a pixel unit 30 having a plurality of pixels 40 coupled to scan lines (S1 to Sn) and data lines (D1 to Dm), a scan driver 10 configured to drive the scan lines (S1 to Sn), a data driver 20 configured to drive the data lines (D1 to Dm), and a timing controller 50 configured to control the scan driver 10 and the data driver 20.

The pixel unit 30 may receive a first voltage (ELVDD) from a first external power source and a second voltage (ELVSS) from a second external power source. Each of the pixels 40 receiving the first voltage (ELVDD) and the second voltage (ELVSS) may receive a data signal when a scan signal is supplied thereto, and may generate light having a luminance corresponding to the received data signal.

For this purpose, at least one transistor may be provided in each of the pixels 40. The transistor may include a gate electrode, a semiconductor layer, a source electrode, and a drain electrode.

The gate electrode, the source electrode and the drain electrode may be made of transparent materials, e.g., indium tin oxide (ITO), indium zinc oxide (IZO), indium tin zinc oxide (ITZO), indium cesium oxide (ICO), etc. The semiconductor layer may form a channel through which a carrier is passed when a drive voltage is applied to the gate electrode. The semiconductor layer may be formed of a transparent material. For example, the semiconductor layer may be formed of oxides, e.g., ZnO, ZnSnO, CdSnO, GaSnO, TlSnO, InGaZnO, CuAlO, SrCuO, and LaCuOS, nitrides, e.g., GaN, InGaN, AlGaN, and InGaAlN, or carbides, e.g., SiC, diamond, etc.

Thus, the thin film transistors included in the pixels 40 of one embodiment of the present invention may be transparent thin film transistors. Therefore, when voltages are not supplied to the organic light emitting display, a background behind the pixel unit 30 may be viewed from the front of the pixel unit 30.

The organic light emitting display including the above-mentioned transparent panel may be used in a variety of applications. For example, when the organic light emitting display is installed in a refrigerator, and external power sources are off, a user can see goods in the refrigerator and, when a power source is turned on, a variety of information may be displayed.

The scan driver 10 may sequentially supply a scan signal to the scan lines (S1 to Sn). When the scan signal is sequentially supplied to the scan lines (S1 to Sn), the pixels 40 may be sequentially selected line by line, and the selected pixels 40 may receive a data signal from the data lines (D1 to Dm).

The data driver 20 may generate data signals using second data (Data2), and supply the generated data signals to the data lines (D1 to Dm) when a scan signal is supplied to the data driver 20. The data signal may be supplied to the pixels 40 selected by the scan signal.

The timing controller 50 may generate a data drive control signal (DCS) and a scan drive control signal (SCS) to correspond to externally supplied synchronizing signals. The data drive control signal (DCS) generated in the timing controller 50 may be supplied to the data driver 20, and the scan drive control signal (SCS) may be supplied to the scan driver 10. The timing controller 50 may convert predetermined bits of externally supplied first data (Data1) to a certain value to generate a second data (Data2), and may supply the generated second data (Data2) to the data driver 20.

More particularly, the timing controller 50 may fix at least one predetermined bit of externally supplied i (i is an integer) bit first data (Data1) to a certain value to generate j (j is an integer equal to or greater than i) bit second data (Data2). For example, the timing controller 50 may fix the last or least significant bit (LSB) of 8-bit first data (Data1) to be "1," and may generate 8-bit second data (Data2) or 9-bit second data (Data2). For example, when first data (Data1) is "00000000," the timing controller 50 may generate second data (Data2) of "00000001" or "000000001."

When 8-bit second data (Data2) is generated by fixing at least one predetermined bit of 8-bit first data (Data1) to a certain value, e.g., "1," a number of available grey levels may be reduced. However, manufacturing cost is not increased. When 9-bit or greater-bit second data (Data2) is generated by fixing the at least one predetermined bit, e.g., (j−i) predetermined bits, of 8-bit first data (Data1), no grey levels may be lost. However, manufacturing cost may be increased. Thus, a number of bits of the second data (Data2) may be varied by a designer in consideration of tradeoffs between manufacturing cost and available grey levels.

Figure 2A:
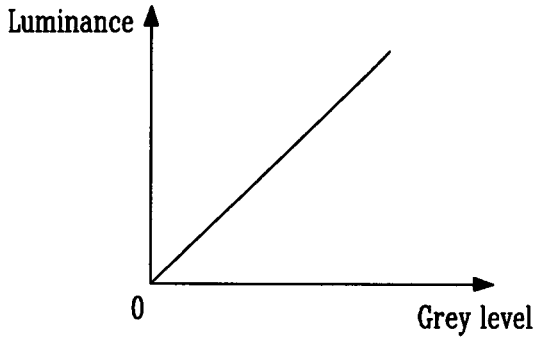
FIGS. 2A to 2C illustrate diagrams of the luminance corresponding to the grey levels of first data and second data.

Grey level characteristics of the first data (Data1) are illustrated in FIG. 2A. Here, light is not output from the pixels 40 when the first data (Data1) is expressed with the minimum grey levels. That is to say, when the first data (Data1) of the minimum grey levels is supplied to all the pixels 40, light is not generated in an organic light emitting diode in each pixel 40.

Figure 2B:
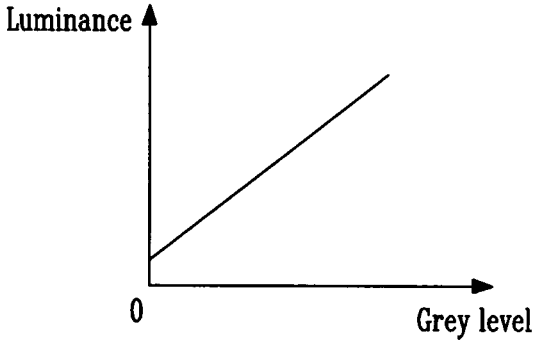
Figure 2C:
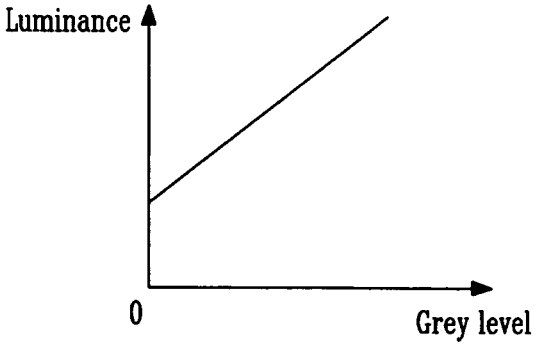

Grey level characteristics of the second data (Data2) in which at least one predetermined bit of the first data (Data1) is fixed to a bit value of "1" are illustrated in FIGS. 2B and 2C. Here, light is output from the pixels 40 when the second data (Data2) is expressed with the minimum grey levels. That is to say, predetermined light is generated in each of the pixels 40 when the second data (Data2) of the minimum grey levels is supplied to all the pixels 40. When the minimum grey levels are expressed, luminance of light output varies according to a position of the predetermined bits fixed to "1."

For example, when LSB bits are fixed to "1," light of a first luminance is output from each of the pixels 40 when the minimum grey levels are expressed, as illustrated in FIG. 2B. Alternatively, when most significant bit (MSB) bits are fixed to "1," light of a second luminance, which is higher than the first luminance, is output from each of the pixels 40 when the minimum grey levels are expressed, as illustrated in FIG. 2C.

When other bits are selected, a luminance output by pixels expressing the minimum grey level will be between the first and second luminances.

As described above, an image is displayed on the organic light emitting display including a transparent panel according to one embodiment of the present invention by using second data (Data2) having at least one predetermined bit of a fixed value. Thus, a high-definition image may be displayed, since transmission of the background in the display may be minimized.

More particularly, second data (Data2) may have at least one predetermined bit fixed to "1" in accordance with one embodiment of the present invention. Therefore, when voltages are supplied to the organic light emitting display, luminance of the certain grey levels, e.g., even those corresponding to black, may be expressed on the pixel unit 30. In this case, the background being viewed through the pixel unit 30 when the minimum grey levels are expressed may be minimized, i.e., some light is output by all pixels of the pixel unit 30.

In contrast, in the conventional transparent panel, since light is not generated in a region where a black color is expressed in accordance with one embodiment, the background will be viewed there through, making display of a high-definition image difficult. However, when light is output by all regions, the background displayed on the pixel unit 30 may be minimized or eliminated, allowing high-definition images to be displayed. While, in accordance with one embodiment, regions expressing black, i.e., the minimum grey level, may output light, sufficient contrast may still be realized such that regions expressing the black color will still be recognized as black, e.g., the difference in luminance of pixels respectively displaying black light and other grey level light may be sufficiently large.

Figure 3:
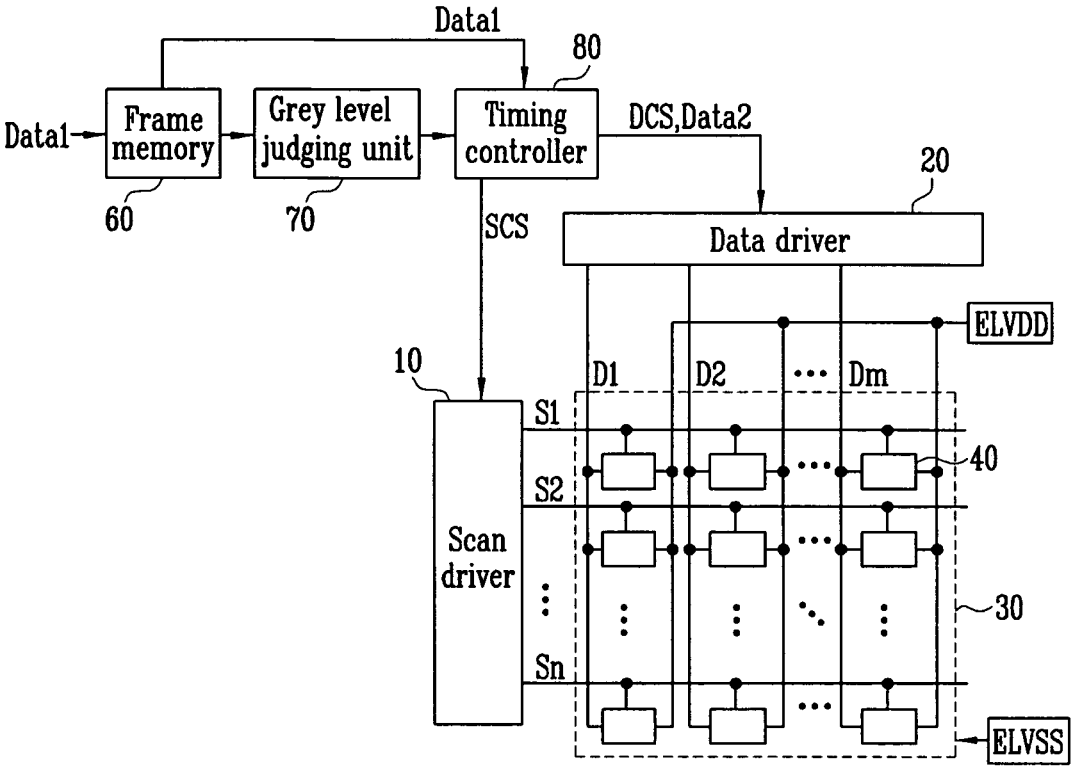
FIG. 3 illustrates a diagram of an organic light emitting display according to another exemplary embodiment of the present invention.

FIG. 3 illustrates an organic light emitting display according to another exemplary embodiment of the present invention. In the description of FIG. 3, the same components have the same reference numerals as in FIG. 1, and their descriptions will not be repeated for clarity.

Referring to FIG. 3, the organic light emitting display according to another exemplary embodiment of the present invention may further include a frame memory 60 and a grey level judging unit 70, both of which may be coupled to the timing controller 80.

The frame memory 60 may store one frame of an externally supplied first data (Data1). The grey level judging unit 70 may analyze grey levels of the first data (Data1) in the one frame stored in the frame memory 60, and supply a control signal, corresponding to the analyzed grey levels, to the timing controller 80.

The timing controller 80 may receive the first data (Data1) from the frame memory 60, and fix at least one predetermined bit of the first data (Data1), corresponding to the control signal, to "1." That is to say, the predetermined bits to be fixed may be selected in accordance with the control signal according to another exemplary embodiment of the present invention.

More particularly, the grey level judging unit 70 may generate a control signal to fix an upper bit value of the first data (Data1) to "1" with an increasing difference in bits of the first data (Data1) stored in the frame memory 60 (i.e., an increasing difference in grey levels). In other words, since image contrast increases with an increasing difference in grey levels of the first data (Data1), for images with higher difference in grey levels, upper bits of the first data (Data1) may be fixed to "1," allowing a stable image to be realized. When upper bit values of the first data (Data1) are fixed to "1," the transmission of the background may be further minimized, allowing display of a high-definition image.

Generally, the greater the available contrast, i.e., differences between grey levels, the higher the bit that may be selected to be set to "1" and the higher the luminance of pixels expressing the minimum grey level. The brighter the pixels expressing the minimum grey level, the less the background image is visible through these pixels. However, this benefit must be weighed against providing sufficient contrast in the entire image.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a plurality of pixels, each pixel including a transparent transistor;

a timing controller configured to receive an externally supplied first data to generate a second data from the first data;

a frame memory configured to store one frame of the first data:

a grey level judging unit configured to supply a control signal to the timing controller corresponding to grey level values of the first data stored in the frame memory; and a data driver configured to receive the second data, to generate a data signal from the second data, and to supply the data signal to data lines coupled to the pixels, wherein the first data comprises of i bits (i is an integer) that includes a most significant bit and a least significant bit, wherein the second data comprises of j bits (j is an integer greater than i) that includes a most significant bit and a least significant bit, wherein the grey level judging unit generates the control signal to control fixing of the most significant bit of the first data to a first value when the i bits of the first data stored in the frame memory represent a high difference in the grey level values, and causes to fix the most significant bit of the i bits of the second data to the first value, and wherein the grey level judging unit generates the control signal to control the fixing of the least significant bit of the first data to a second value when i bits of the first data stored in the frame memory represent a low difference in the grey level values, and causes to fix the least significant bit of the i bits of the second data to the second value.

2. The organic light emitting display as claimed in claim 1, wherein the certain value is "1."

3. A method for driving an organic light emitting display having a frame memory configured to store one frame of the first data, a grey level judging unit configured to supply a control signal to the timing controller corresponding to grey level values of the first data stored in the frame memory, and having a plurality of pixels, each pixel including a transparent transistor, the method comprising:

generating a second data, the second data including j bits (j is an integer) that includes a most significant bit and a least significant bit, from an externally supplied first data, of the first data including i bits (i is an integer less than i) that includes a most significant bit and a least significant bit;

generating a control signal to control fixing of the most significant bit of the first data to a first value when the i bits of the first data stored in the frame memory represent a high difference in the grey level values, and to cause the most significant bit of the j bits of the second data to be fixed to the first value, generating the control signal to control the fixing of the least significant bit of the first data to a second value when i bits of the first data stored in the frame memory represent a low difference in the grey level values, and to cause the least significant bit of the j bits of the second data to be fixed to the second value;

generating a data signal using the second data; and displaying an image using the data signal.

4. The method as claimed in claim 3, wherein the certain value is "1."

5. A driving system configured to drive an organic light emitting panel, the driving system comprising:

a timing controller configured to receive an externally supplied first data, the first data including i bits (i is an integer) that includes a most significant bit and a least significant bit, and to generate a second data, the second data including j bits (j is an integer greater than i) that includes a most significant bit and a least significant bit;

a frame memory configured to store one frame of the first data:

a grey level judging unit configured to supply a control signal to the timing controller corresponding to grey level values of the first data stored in the frame memory; and a data driver configured to receive the second data, to generate a data signal from the second data, and to supply the data signal to data lines coupled to the organic light emitting panel, wherein the grey level judging unit generates the control signal to control fixing of the most significant bit of the first data to a first value when the i bits of the first data stored in the frame memory, represent a high difference in the grey level values, and causes to fix the most significant bit of the j bits of the second data to the first value, and wherein the grey level judging unit generates the control signal to control the fixing of the least significant bit of the first data to a second value, when i bits of the first data stored in the frame memory represent a low difference in the grey level values, and causes to fix the least significant bit of the j bits of the second data to the second value.

6. The driving system as claimed in claim 5, wherein the certain value is "1."

* * * * *